United States Patent [19]

Schönemann

[11] Patent Number: 4,658,486

[45] Date of Patent: Apr. 21, 1987

[54] FLUID-MEDIUM-HEATED CALENDER ROLL

[75] Inventor: Joachim Schönemann, Netphen, Fed. Rep. of Germany

[73] Assignee: Walzen Irle GmbH, Netphen, Fed. Rep. of Germany

[21] Appl. No.: 720,700

[22] Filed: Apr. 8, 1985

[30] Foreign Application Priority Data

Apr. 6, 1984 [DE] Fed. Rep. of Germany ... 8410839[U]
Dec. 14, 1984 [DE] Fed. Rep. of Germany ... 8436564[U]

[51] Int. Cl.[4] ..... B21B 31/08; B60B 7/04

[52] U.S. Cl. ..... 29/123; 29/110; 162/121

[58] Field of Search ..... 29/124, 110, 123; 425/DIG. 234; 162/121, 122

[56] References Cited

U.S. PATENT DOCUMENTS 3,852,860 12/1974 Tewes ..... 29/110
4,090,553 5/1978 Beghin ..... 29/110
4,235,002 11/1980 Pav et al. ..... 29/110

*Primary Examiner*—Mark Rosenbaum
*Assistant Examiner*—Irene Graves Golabi
*Attorney, Agent, or Firm*—Karl F. Ross; Herbert Dubno

[57] ABSTRACT

A calender roll comprises a substantially cylindrical roll body formed with a multiplicity of angularly equispaced axial heating passages proximal to a rolling periphery of the body, and a pair of recesses opening axially outwardly at opposite ends thereof, the recesses having bottom surfaces; and respective flange journal stubs formed with end faces defining respective gaps with the bottoms of the recesses. The gaps communicate with the axial passages and at least one of the stubs is provided with an axially extending bore communicating with at least one of the gaps for passing a heating medium through the axial passages. The heating medium is distributed to the axial passages by one of the gaps and is recovered from the axial passages by the other of the gaps.

13 Claims, 11 Drawing Figures

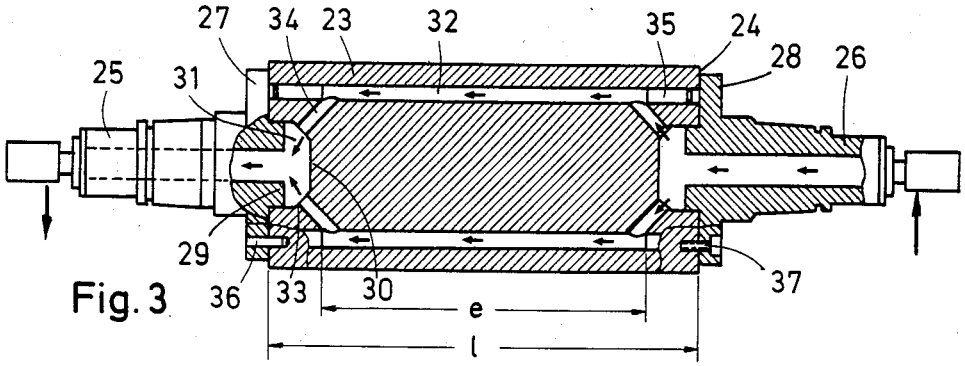
Fig. 3
Fig. 4
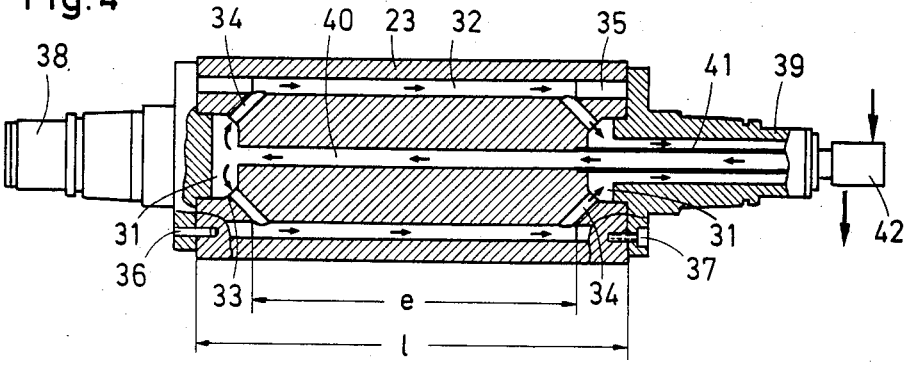
Fig. 5
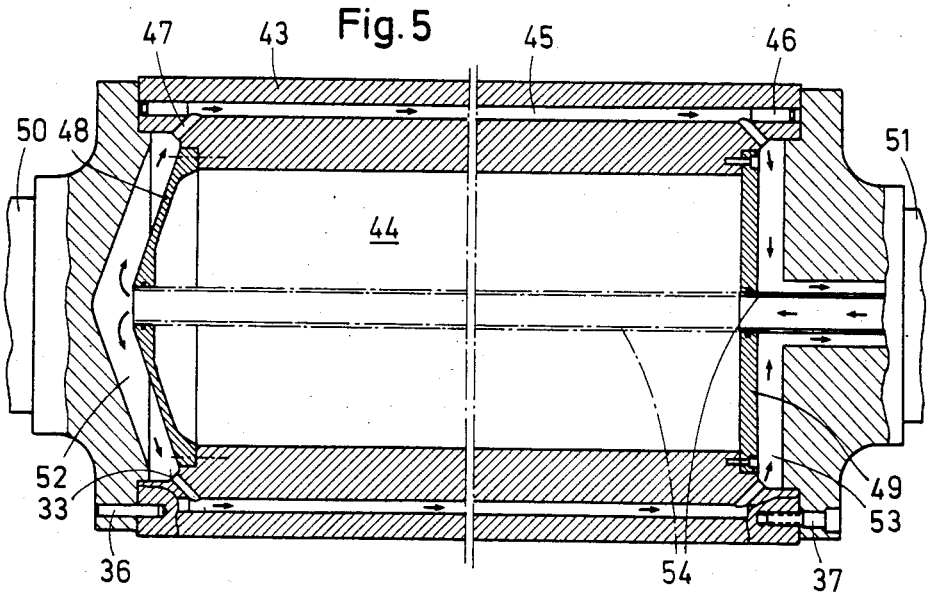

FLUID-MEDIUM-HEATED CALENDER ROLL

FIELD OF THE INVENTION

The present invention relates to a heatable calender roll and, more particularly, to a calender roll which can be heated by the passage of a fluid medium through a multiplicity of passages formed parallel to the axis of the roll and parallel to generatrices of the roller surface immediately below the roller surface, i.e. radially inwardly thereof.

BACKGROUND OF THE INVENTION

Calender rolls which are heated by a liquid medium, i.e. a circulated heating fluid, are commonly used in the paper, rubber and synthetic resin (plastics) industry and can have a considerable length. Such rolls must be manufactured and operated within narrow tolerances, especially with respect to their journaling members or stub shafts and can have temperatures well above ambient temperatures, e.g. as much as 200° C.

The stub shafts could not effectively be provided heretofore with axial bores through which the heating medium was conducted to the bores or passages of the roll without problems.

For example, when the array of peripheral passages was connected by individual bores with a throughgoing passage of the journaling shaft, various flow velocities of the medium through these connecting passages, variations in the wall thickness of the latter connecting passages, the thermal inertial of the surrounding regions of the roll and like factors resulted in variations in the heating effects at various locations, making it expensive to fabricate calender rolls operating within high tolerances or narrow tolerances, and to maintain such calender rolls.

To reduce these costs and to provide the heating medium so that it only heated the regions of interest, calender rolls were developed which had a hollow interior and were connected at one end with appropriate fittings for feeding the medium to and removing the medium from the hollow calender roll. Within the calender roll the medium was distributed by baffle bodies or other displacement-causing elements forming an annular passage cross section for the medium which was of comparatively small thickness. This provided a better defined path for the medium and in large measure avoided the problems which hitherto arose with thermal inertia. However, with these calender rolls another problem developed, namely, a problem with respect to acceleration and velocity of the calender roll. As the calender roll accelerated or was rotated at high speed, for example, the baffle arrangements within the hollow calender roll tended to loosen or become liberated, creating significant problems of maintenance and down time.

Since such calender rolls must be accelerated frequently from standstill at high rates to maximum speed, e.g. in the paper, foil or strip forming field, the shocks which were applied to the calender roll as a result of the problems of securing the displacement or baffle bodies caused tearing, deformation and like damage to the product as well.

Not only was repair of the roll costly and time consuming, but significant danger of product damage arose.

OBJECTS OF THE INVENTION

It is, therefore, the principal object of the present invention to provide a calender roll which can be heated by a flowable medium in the manner previously described, but wherein the heating effect can be applied with precision to the periphery of the calender roll and, if desired, even to selected portions of the periphery, while high speeds and accelerations both in the positive and negative sense, are incapable of damaging the calender roll.

Another object of this invention is to provide a calender roll which is comparatively robust, i.e. can be repeatedly accelerated and decelerated without detrimental effect and which can, therefore, have a long operating life.

Still another object of this invention is to provide an improved calender roll with more effective distribution of heat to the periphery of the calender roll without problems involving the journaling and fabrication tolerances of a calender roll.

It is also an object of this invention to provide a calender roll which is more satisfactory for use in the paper, plastic-foil and rubber-strip or band industries.

SUMMARY OF THE INVENTION

These objects and others which will become apparent hereinafter are provided, in accordance with the present invention, in a calender roll formed as a generally cylindrical body having radially inwardly from its periphery an array of bores extending parallel to the axis of this body and adapted to be traversed by the heating medium.

According to the invention, attached at each end of this body is a respective flange journal stub which at least one of which is provided with an axial bore for communication with the angularly equispaced passages of the body. According to a feature of the invention, an end surface of the cylindrical body is spaced from an end surface of the flange journal stub provided with that axial bore to define a radially outwardly extending annular gap which communicates between the axial bore and the aforementioned angularly equispaced passages.

According to a feature of the invention, the end gap-defining surface of the body is set inwardly from the actual extremal face thereof while the corresponding end face of the flange journal stub is formed on a cylindrical boss or step of this stub which fits into a cylindrical recess of the body.

While indeed it is known to provide stub shafts as journal members on calender roll bodies for cases in which the calender roll casting might not have sufficient toughness to withstand the journaling action and supporting forces which the journaling stubs must take up, these stub shafts did not fulfill functions similar to those which are fulfilled by the flange journal stub of the invention, i.e. that of defining a thin or narrow annular passage communicating between the axial bore in a flange journal stub for feeding or withdrawing a heating medium from the array of angularly equispaced heating passages and communicating as well with these passages.

The communication with these passages is therefore effected without any complex machining operations so that the calender rolls can be fabricated comparatively inexpensively and can be maintained and repaired at relatively low cost.

The calender roll body can be practically formed in one piece and this is even the case when, as required, different casting alloys may be used for portions at different radial distances from the axis thereof so that the calender roll can have an extremely stable construction even under thermal and mechanical stress. The calender roll is therefore able to be accelerated at extremely high rates and to comparatively high speeds without internal deformation and without distortion. At the same time a well defined path for the thermal medium is achieved as defined at least in part by the gap communicating between the passages and the axial bore and consequently, the desired degree and locus of heat transfer can be ensured.

A highly loadable central connection of the flange journal stub with the calender roll body can be achieved when, in the manner previously described, a radially outwardly extending flange surrounds the axially extending boss previously mentioned and the axially extending boss engages in a plug fit in a recess formed at the corresponding end of the calender roll body. In this case, the flange can be bolted to the extremal end face of the calender roll body surrounding the recess while the floor of the recess defines the aforementioned gap with the end surface of the boss previously mentioned.

It has been found to be advantageous to make the two surfaces which are spacedly juxtaposed to form the narrow gap or spacing parallel to one another. Advantageously, both of these surfaces can be slightly frustoconical and, advantageously, can diverge in the direction of flow from the incoming medium axial bore to the axial passages of the calender roll body or, conversely, can converge from these passages in the direction of flow to the outlet axial bore.

When mechanical stability may be a problem, the axial passages in the calender roll body are provided along a circle which lies significantly radially inwardly from the cylindrical surface of the calender roll. Of course, the axial passages can be located much closer to the cylindrical surface of the calender roll when, for example, a greater number of such passages is desired.

In the latter case, of course, the circle along which the axes of this array or family of axial passages lie will be greater.

In the latter case it has been found to be advantageous to provide between the aforementioned gap or spacing and the axial passages which may lie close to the periphery of the body, a family of connecting passages which can be inclined along generatrices of respective frustocones.

This allows the thickness of the roll body to be maintained and, indeed, to be considerable in spite of the fact that the axial passages may be located close to the periphery thereof. From the inlet gap and its axial bore, therefore, the connecting passages may diverge radially to the axial passages while the connecting passages may converge frustoconically from the axial passages toward the annular gap communicating with the axaial outlet bore in another flange journal stub according to the invention.

It has been found to be advantageous to have the connecting passages communicate with the axial heating passages at locations inwardly of respective ends of these passages, thereby allowing the axial passages to be formed economically and simply by boring through the calender roll body in a rectilinear manner. In that case, the ends of the axial passages may advantageously be plugged, i.e. provided with plugs. This also has the advantage that it prevents flow of the heating medium into regions of the axial passages at the ends of the calender roll.

The connecting passages preferably are formed perpendicularly to profile flanks of the respective recesses while the plugs can be provided with O-rings or like seals which can be seated in grooves formed in the peripheries of these plugs.

By restricting the flow of the heating medium to the ends of the axial bores, the heating effect can be confined to a central region. This may be important in the paper industry, for example, where the paper web may have been dried previously along its periphery so that any further heating along the periphery may result in less heat transfer from the calender roll and hence overheating of the latter which might result in distortion. It is possible using the aforementioned plugs, therefore, to restrict the zones of the axial passages which will be heated.

The throughflow of the medium can be controlled, whether it is for a cooling medium or a heating medium and, in this case, generally for a heating medium, by providing the axial passages in grooves and so connecting these passages that the heating medium will flow from one gap through a group of such passages in parallel and then to the other gap and from that gap through another group of such passages in parallel but in the opposite direction. An alternating flow of the fluid in direction through passages of respective groups can thus be ensured and, for example, the canals or passages of one group are traversed by the same medium but subsequently to the canals or passages of another group. As a consequence, the general pattern of flow through the axial passages of the calender roll can be a meander form or the like. Only when the flow emerges from the last group of passages or from the last passage of each group does it enter the opposite annular gap.

For closing and connecting the passages in the aforedescribed manner, rings, disks, projections or like fittings can be provided and can be held in place by or mounted upon the respective flange journal stubs.

Cross passages or through openings can be provided between axial passages to be connected in succession and these interconnecting passages, bores or the like can be closed from the annular gaps by the disks, rings or other fittings or can be connected to the annular gaps by recesses, cutouts, grooves or the like in portions of the flange journal stubs adjacent the respective bosses, in the respective bosses or at the respective end faces.

The inlet or outlet ends of a groove of passages to be traversed in succession by the medium can be provided with connecting bores which run substantially along generatrices of a frustocone which converges or diverges and the interconnecting bores can be additionally inclined with respect to the generatrices so that they cross for convenience of fabrication. Their ends, in turn, can be blocked by plugs.

The weight of the calender roll can be reduced by boring through the latter to form a hollow interior thereof with this hollow space being closed at one end by a disk which is introduced into a recess in the body. The latter can be formed with openings, passages, cutouts or the like to effect the aforementioned flow of the heating medium and at least one such disk can provide an end face for the calender roll body which defines the annular gap previously mentioned.

When the roll is not a driven roll, the feed and discharge bores can extend to their base surfaces so that through one flange journal stub, the heating medium can be fed to the calender roll whereas the heating medium can be discharged through the other flange journal stub.

However, for driven calender rolls it is desirable to feed and withdraw the medium from one side only so that the flange journal stub of the other side can be free from the axially extending bore which might otherwise be required for the medium.

In the latter case, the flange journal stub provided with the axial bore can also have a tube extending therethrough to separate two flow paths, namely, a central inlet flow path from a peripheral outward flow path.

The tube can communicate with an axial bore through the calender roll body or some other passage formed therein so that it is connected with the annular gap formed at the opposite end of the calender roll body, i.e. between the flange journal stub and the calender roll body where this flange journal stub does not have an axial bore.

BRIEF DESCRIPTION OF THE DRAWING

The above and other objects, features and advantages of the present invention will become more readily apparent from the following description, reference being made to the accompanying drawing in which:

FIG. 3 is another partial axial section of a calender roll with the ends of the axial bores thereof plugged and hence the heating zone confined only to a central portion of the calender roll;

FIG. 4 is a view similar to FIG. 3 in which, however, both the feed and the discharge of the heating medium are effected at one end of the calender roll;

FIG. 5 is an axial section, partly seen in elevation and partly broken away, of a calender roll which has been made lighter by the formation of a central bore therein;

SPECIFIC DESCRIPTION

Figure 1:
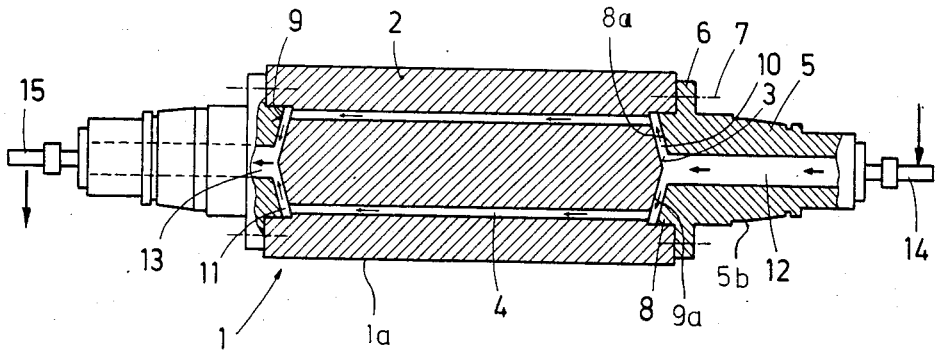
FIG. 1 is an axial cross-sectional view, partly seen in elevation and in highly diagrammatic form, illustrating a calender roll according to the invention in which the heating medium is fed through one flange journal stub and is discharged from the opposite flange journal stub.

As can be seen from FIG. 1, a calender roll 1 can comprise an outer cylindrical or rolling surface 1*a* which is provided along a circle radially inwardly of this calender roll surface, a family of axial passages 4 which extend parallel to the generatrices of the cylindrical roller surface 1*a* and to the axis, not designated, of the roll body 2.

Figure 1A:
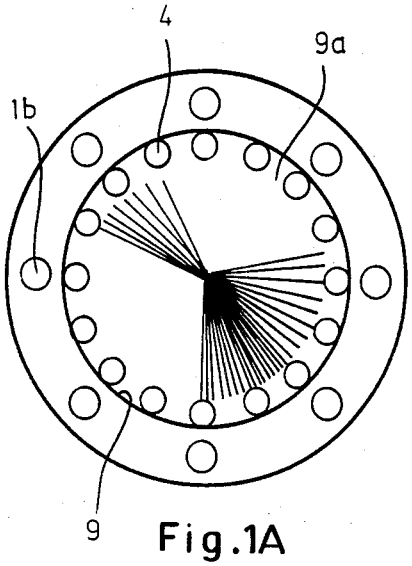
FIG. 1A is a right-hand end view of the calender roll body, the flange journal stub at this end having been removed.

As can be seen from FIG. 1A, the passages 4 are angularly equispaced and open within respective recesses 9, a circle of axial bores 1*b* being provided so that these bores can be aligned with the bores 5*a* through which the bolts 7 can pass to effect a flange connection as will be described.

The ends of the body 2 are provided with the flange journal stubs 5, of which both are shown to be provided with axial bores in FIG. 1.

Each flange journal stub 5 has an annular flange 6 which extends radially outwardly and surrounds a cylindrical boss 8, the flange 6 being provided with the bores 5*a* previously mentioned.

The flange journal stubs 5 can also be provided with shanks 5*b* which can engage the bearing of respective journal blocks rotatably supporting the respective rolls.

Figure 1B:
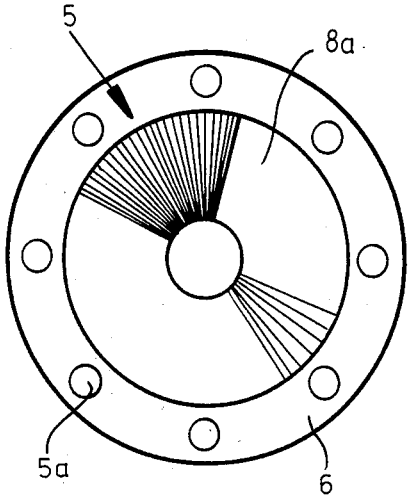
FIG. 1B is an end view of the flange journal stub showing the end thereof which is to be bolted to the calender roll body.

The screws or bolts 7 so connect the flange journal stubs 5 to the roll body 2 that the boss 8 fits snugly and sealingly within the recess 9. The boss 8 has an end face 8*a* and the recess 9 has an end face 9*a* (see FIGS. 1, 1A and 1B) which are parallel to one another and are slightly frustoconical so that they define annular gaps 10 and 11 with one another. The ends of the axial passages 4 open into these gaps and as can be seen from FIG. 1, the gap 10 diverges radially outwardly toward the passages 4 while the gap 11 converges radially inwardly.

Each of the narrow annular gaps communicates with an axial bore 12 and 13 extending through the respective flange journal stub 5. The bore 12 is provided as an inlet bore for the heating medium whose flow is represented by the arrows in FIG. 1, whereas the bore 13 is the discharge bore The axial bores 12 and 13 are connected with respective heads 14 and 15 which allow the conduits for circulating the heating medium to be connected to the rotating calender roll.

After entering via axial inlet bore 12, the heating medium flows radially outwardly through the gap 10 to the axial bores 4 then along the axial bores to heat the calender roll body 2 and then inwardly through the gap 11 to be finally discharged via the axial bore 13 and the outlet head 15.

The heating fluid circuit is otherwise not shown but will be understood to include thermostats or the like as may be required to control the heating of the calender roll.

The calender roll is thereby heated in a stable manner without distortion or deformation and to a degree determind by the number of axial passages 4 and the manner in which the fluid is fed to them.

The roll shown in FIG. 1 is generally a nondriven roll, i.e. neither of the flange journal stubs 5 is provided with a drive mechanism.

Figure 2:
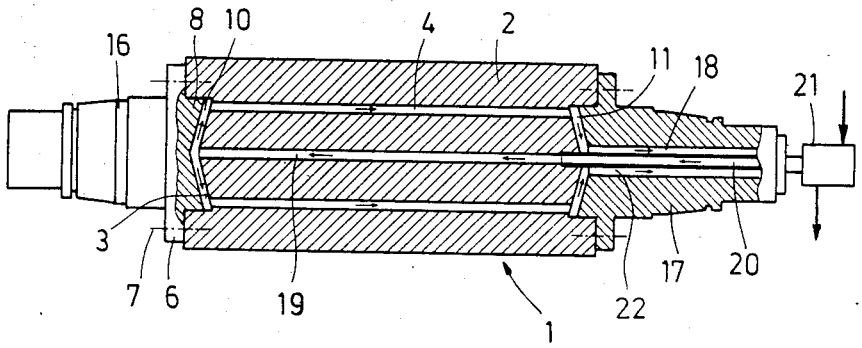
FIG. 2 is an axial section similar to that of FIG. 1 in which the heating medium is fed and discharged from the same end, the other flange journal stub being free from any axial bore traversed by the heating medium.

However, in FIG. 2 a driven roll has been illustrated. In this case, the flange journal stub 16 which is the driven stub is not only journaled but can be connected to a drive gear or the like.

In this case, it is preferred that the driven stub 16 be free from any axial bore.

The other axial stub 17, therefore, can be provided with an axial bore 18 through which a tube 20 can extend.

The bosses 8 of the flange journal stubs here form the respective annular gaps 10 and 11 with the calender roll body 2 in the manner described, although the inlet gap 10 is fed by an axial bore 19 through the calender roll body 2 communicating with the tube 20. In this case, the two coaxial passages defined in the stub 17 are connected by a head 21 providing both the inlet and the outlet for the heating medium.

The calender roll otherwise operates in the manner described with respect to the calender roll 1.

The tube 20 is sealed in a slightly enlarged end of the bore 19.

The thermal medium, therefore, is fed through the head 21 and the interior of the tube 20 as shown by the arrows, through the bore 19 and into the annular gap 10 defined between the end faces 3 of the body 2 and the boss 8, to pass outwardly in a divergent manner to the axial passages 4. The medium flows through these passages in the opposite axial direction and is collected in the annular gap 11 passing radially convergingly to the axial bore 18 and the space 22 surrounding the tube 20 before being discharged via the head 21.

In this case as well a defined more or less sealed flow through the axial passages 4 of the thermal medium is effected and the cost of providing two axial bores in the stubs is eliminated so that one of these stubs can be formed as a one-piece strong body capable of applying the driving torque to the calender roll without difficulty. Problems with baffles and displacement bodies are eliminated.

The number of passages 4 provides the requisite heat exchange surface between the thermal medium and the roll body and its calendering surface to achieve the desired heating effect.

In practice it has been found that in many cases the heating of the calender roll over its entire length is not desirable or rather that it is not desirable to heat the calender roll uniformly over its entire length.

This is especially the case in paper manufacture where the edges of the paper web tend to dry more rapidly than the inner zones thereof. If the calender roll is heated uniformly over its entire length and the heated calender roll is brought into contact with the paper web which has its edge regions partially or completely dried, the abstraction of heat from the calender roll is less, i.e. the heat transfer from the ends of the calender roll is less in the previously dried regions of the web than in the interior regions thereof. As a consequence, the heating effect on the web is nonuniform if the roll is heated uniformly and, conversely, the roll may transfer more heat in its central zone than along its extremities so that a thermal gradient is established in the roll which may cause bending thereof.

Accordingly, it is advantageous to connect the aforementioned gaps with the axial passages inwardly of the extremely ends of these gaps. The embodiments of FIGS. 3–5 and 7 are intended to illustrate this kind of construction. In these figures, the calender rolls concentrate the heating inwardly of the axial ends of the passages by providing these ends of the passages with plugs to reduce the effective lengths thereof.

Figure 3A:
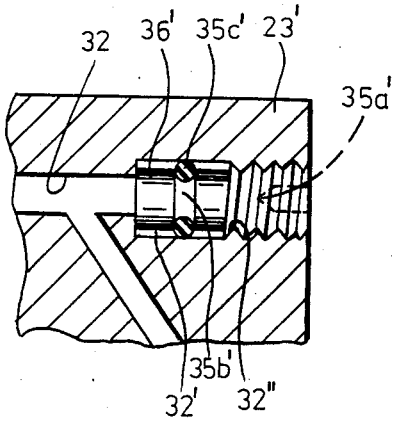
FIG. 3A is a detail section showing a plug according to the invention.

As can be seen in FIG. 3A, each of the plugs, which has been diagrammatically illustrated at 35, for example, or 46 in the embodiments of FIGS. 3–7, has been shown as a member 35' which is seated against a shoulder 32' formed between a portion 32'' of larger diameter and the axial passage 32 of a calender roll body 23'. The end of the section 32'' of the bore is internally threaded, and plug 35' can be externally threaded at **35*a'* and can also be provided with an annular groove 35*b'* receiving an O-ring 35*c'*** or some like sealing member. Other means for securing the plug in place can be used as will be mentioned and other sealing ring arrangements can be employed as well.

In addition, instead of the axial passages 32 being located a single circle, passages **32*a* and 32*b* can be provided on respective circles of different diameter, the circles 32*a* and 32*b*** being radially staggered around the calender roll body.

FIG. 3 shows a calender roll which, at both of its end faces 24 of the roll body 23 can be flanged to respective flange journal stubs 25 or 26, the screws being represented by the single screw 37 which has been illustrated while the reference numeral 36 represents a centering pin for positioning the stubs with respect to the roll body.

The flanges 27 and 28 of the stubs 25 and 26 can be provided with the bores as previously described traversed by the screws 37 and with the pins 36 for centering purposes Each of these flanges 27, 28 surrounds a cylindrical boss 29 the end face of which defines an annular gap with the floor 30 of a respective recess snugly receiving the boss and the gaps have been represented at 31. One of these gaps serves to deliver the heating medium to the axial passages 32 while the other gap 31 recovers the heating medium from these axial passages 32.

Figure 3B:
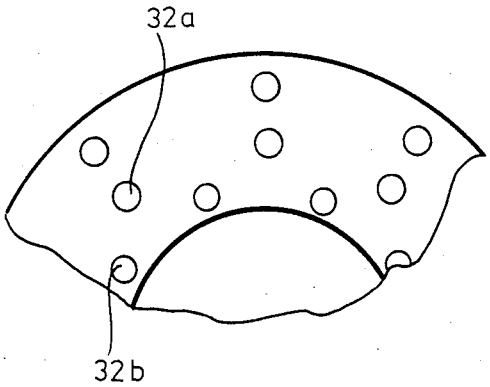
FIG. 3B is a fragmentary end view showing an arrangement in which the array of axial bores is in the form of two sets along respective circles.

The axial passages 32 are likewise bores which extend through the length of the roll body and are angularly equispaced along a single circle as shown in FIG. 3 or along two or more circles as represented by FIG. 3B.

In the latter case, therefore, the axial passages 32 alternatingly are at different distances from the free rolling surface of the calender roll.

The recesses 30 of the roll body are provided with a frustoconical flank 33 from which connecting bores 34 extend perpendicularly and along the generatrices of respective frustocones divergingly outwardly or convergingly inwardly to connect with the axial passages 32 and effect communication between these axial passages and the annular gaps 31.

The ends of the passages 32 are overhung by the flanges 27 and 28 and are additionally closed by the plugs 35 previously mentioned. As a consequence, the heating medium is introduced into each axial passage axially inwardly from one end and is recovered from this axial passages axially inwardly from the opposite end thereof. As a consequence, the heating zone is confined to the region e although the actual length of the roll body is represented by the dimension 1.

Other means of fixing the plugs in place can include spring rings or other locking or indexing rings or the provision of flanks or shoulders in the axial passages or adjoining them to secure the plugs in place. The flanges 27 and 28 can also be used to secure the plugs in place.

In the event the flanges 27 and 28 are provided with formations which engage in the passages 32 to hold the plugs 35 in place, the centering pins 36 assist in aligning these projections with the passages 32. Other types of sealing rings may be used as well.

The flange journal stubs 25 and 26 are provided with axial bores in the manner previously described and with associated connecting heads to allow the heating medium to be circulated through the calender roll body. As in the embodiments previously described, the heating medium is distributed to the connecting passages 34 via the gap 31 at the inlet side and is collected from the connecting passages 34 via the gap 31 at the opposite side. Flexible tubing can connect the heads in the heating medium circulating line.

The paper web is thereby heated over the limited zone e of its width and there is no problem with heat abstraction from the regions of the calender roll which extend beyond this zone.

FIG. 4 shows an embodiment which operates similarly to that of FIG. 2 but which utilizes the principles demonstrated in FIG. 3.

Here the flange journal stub 39 is connected to a head 42 which feeds the heating medium 2 and removes it from the calender roll and is traversed by a tube 41 extending through its axial passage and communicating with a bore 40 within the roll body 23. In this embodiment, as in the embodiment of FIG. 2, the flange journal stub 38 is not provided with an axial bore although it participates in defining a gap 31 through which the heating medium is delivered via the connecting passages 34 to the axial passages 32. Except for the fact that the heating medium is delivered and recovered from the same end, therefore, the driven calender roll of FIG. 4 operates in the same manner as that of FIG. 3 as to the distribution of the heating medium flow and in the manner with respect to FIG. 2 in providing a defined flow path.

FIG. 5 illustrates an embodiment of the invention in which the calender roll is driven by a flange journal stub 50 which is not provided with an axial bore and is supplied with the heating medium and discharged of the heating medium through the flange journal stub 51 more or less in the manner previously described in connection with FIG. 4.

Here, however, the roll body 43, to reduce its weight, is hollowed out in its central region 44 by axial boring and this hollow is closed by a pair of disks 48 and 49. While the disks 48 and 49 are shown to be of different cross section, in practice they will generally be of the same cross section, either the frustoconical configuration shown for the disk 48 which promotes flow or the flat configuration for the disk 49 which facilitates fabrication and reduces the cost.

Both disks are attached by screws to the roll body 43 in respective recesses at the bottoms of the gap defining recesses thereof so that the disks define the end faces or bottoms of the recesses in the roll body 43 providing the annular gaps 52 and 53 with the flange journal stubs 50 and 51, respectively.

A tube 54 can extend through the interior of the roll body to deliver the heating medium to the gap 52 or the hollow 44 may be used for this purpose, the disks 48 and 49 being provided with openings to allow this flow.

Naturally, when the principles of the embodiment of FIG. 5 are to be used with a flow of the heating medium in one direction (in accordance with the principles of FIGS. 1 and 3, for example), the flange journal stub 50 will be provided with an axial bore and one or both of the disks 48 and 49 can be sealed off and free from any tube or bore. By avoiding the complete of the hollow 44 with the medium, either by providing the tube 54 or by providing uniflow of the heating medium through the calender roll, the weight of the calendering roll is reduced still further.

In all of FIGS. 1–5, the passages 4, 32 and 45 are traversed in parallel and in the same direction with the heating medium and this may result in an undesirably high flow cross section of the medium and thus an undesirably high flow rate of the medium through the system. To reduce the flow of the medium or the overall cross section, the passages 4, 32 and 45 can be traversed in groups in alternate directions with the groups being groups of three or 5 or even seven passages so that ultimately the group of passages is fed from one end and discharged from the opposite end utilizing the annular gap arrangements of FIGS. 1–5.

These gaps can be used in conjunction with groupings of two and four passages, if desired and, indeed, any form of meander or interconnection of the passages can be utilized to obtain a desired length of the flow path and distribution of the heating medium.

Figure 6:
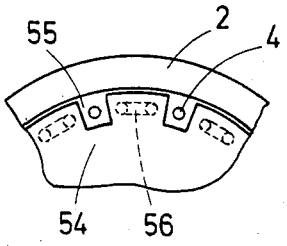
FIG. 6 is an enlarged and partially broken end view of a calender roll body showing the connection of axial passages and groups for successive passages of the heating medium therethrough in a meandering pattern.

The manner in which this is achieved according to the invention has been illustrated in FIG. 6 from which it will be apparent that an end face of the calender roll body can be provided with a disk 54 or a corresponding ring which is formed with throughopenings 55 enabling communication with the respective gap or between the respective gap and corresponding passages, while bridging other passages to establish the meandering path by isolating the ends of these passages from the respective gaps. The connections can be effected by grooves 56 in this ring or in the end face of the roll body against which the ring is applied.

In a similar manner, the bosses of the flange journal stubs can be provided with formations defining these connecting grooves or passage-blocking members.

Such rings, disks or formations of the flange journal stubs can also be used when the passages 32 or 45 are supplied or drained via the connecting bores 34 or 47.

Figure 7:
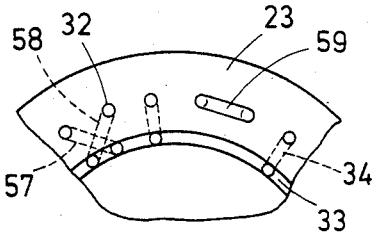
FIG. 7 is a corresponding end view of a calender roll body in which a number of crossing connecting bores have their ends closed by plugs.

Special structural elements can be avoided in the case shown in the broken end view of the roll body of FIG. 7 which can have the passages 32 within the roll body 23 in the usual manner and connect the passages 34 directly to them in a substantially inclined divergent manner. To close off these passages with respect to the gap and to allow interconnection of these passages, the further interconnecting bores 57 and 58 are provided which are formed with respect to the frustoconical flanks 33 that they cross and their ends can be provided with plugs. In this manner as well, a number of passages can be connected into a group of passages to be traversed in succession by the same medium but in alternately opposite directions. In that case, if three passages are interconnected in a common group, by comparison with the embodiments of FIGS. 1–5, for example, the flow rate can be reduced to a third and a smaller supply or connection cross section and a smaller unit for controlling the flow and the heating of the medium can be provided. When the flow rate is not to be reduced to such a great extent, the flow velocity can be increased.

It will be apparent that in all of the embodiments illustrated and described, at comparatively low cost a highly stable construction of the calender roll body is obtained with minimal expenditure for maintenance, inspection and repair. Distortion is minimized and both assembly and fabrication are simplified.

Indeed, the calender rolls will be found to have, with the present invention, at increased stiffness and resistance to bending by comparison with calender rolls using displacement bodies and accomplishing essentially the same result, with the calender rolls of the invention being even of a smaller diameter. There is nothing within the interior of the calender rolls of the body which is analogous to the baffles previously required and which can become loose and cause problems of the type previously described so that the useful life of the calender rolls of the invention is greatly increased.

What is claimed is:

1. A paper calendering roll, comprising:

a substantially cylindrical one-piece roll body formed unitarily and directly with a rolling peripheral surface and formed unitarily and directly with a multiplicity of angularly equispaced axially extending heating bores in the material of said body proximal to said rolling peripheral surface whereby said bores are formed exclusively in and are exclusively defined by said material of said body, said body having a pair of cylindrical annular formations composed of said material projecting axially at opposite ends thereof and integral and unitary with the remainder of said body, each of said cylindrical annular formations surrounding an inner portion of said body defining a respective recess opening axially outwardly at the respective end of said body, said recesses having bottom surfaces, each of said bores opening into a respective one of said recesses at each end of said body; and respective flange journal stubs formed with end faces defining respective gaps with the bottoms of said recesses, said gaps communicating with said axial heating bores, at least one of said stubs being provided with an axially extending communication bore communicating with at least one of said gaps for passing a heating medium through said axial heating bores, said heating medium being distributed to said axial heating bores by said one of said gaps and being recovered from said axial heating bores by the other of said gaps, said stubs having annular flanges bolted to end faces of said formations and with cylindrical bosses extending into said formations and provided with the end faces of the stubs which define said gaps with the bottoms of said recesses.

2. The calender roll defined in claim 1 wherein each of said gaps is substantially frustoconical in configuration.

3. The calender roll defined in claim 1 wherein said axial heating bores lie along a circle whose diameter is substantially less than the diameter of said body.

4. The calender roll defined in claim 1, further comprising a family of connecting passages formed in said body and lying along generatrices of respective frustocones connecting each of said gaps with respective ones of said axial heating bores, said connecting passages communicating with the respective axial heating bores inwardly of ends thereof, said ends of said axial heating bores being provided with respective plugs.

5. The calender roll defined in claim 4 wherein said plugs each extend substantially from the respective end of a respective axial heating bore to a junction of one of said connecting passages therewith.

6. The calender roll defined in claim 5 wherein each of said plugs has a circumferential groove receiving a respective sealing ring.

7. The calender roll defined in claim 4 wherein said recesses are provided with inclined flanks, said connecting passages being perpendicular to said flanks.

8. The calender roll defined in claim 1, further comprising means at each end of said body connecting said axial heating bores in series in groups whereby said medium flows alternately in opposite direction through successive axial heating bores of each group.

9. The calender roll defined in claim 8 wherein said means includes means for blocking communication between some of said axial heating bores and said gaps, and provided with grooves for interconnecting axial heating bores blocked from communication with said gap at respective ends of said bodies.

10. The calender roll defined in claim 9 wherein the last-mentioned means includes crossing bores provided with plugs.

11. The calender roll defined in claim 1 wherein said body is hollowed out and has a hollow between two disks.

12. The calender roll defined in claim 1 wherein only one of said stubs is provided with one of said axial communicating bores and a tube extends through said axial communicating bore to communicate with the other of said gaps.

13. The calender roll defined in claim 1 wherein each of said stubs is provided with such an axial communicating bore connected to the respective gap.

* * * * *